United States Patent [19]

Baggi

[11] Patent Number: 4,468,998

[45] Date of Patent: Sep. 4, 1984

[54] HARMONY MACHINE

[76] Inventor: Denis L. Baggi, Schaffhauserstr. 139, 8057 Zurich, Switzerland

[21] Appl. No.: 411,427

[22] Filed: Aug. 25, 1982

[51] Int. Cl.[3] ..... G10F 1/00

[52] U.S. Cl. ..... 84/1.03; 84/DIG. 22

[58] Field of Search ..... 84/1.01, 1.24, 1.03, 84/DIG. 12, DIG. 22

[56] References Cited

U.S. PATENT DOCUMENTS

| | | | |
|---|---|---|---|
| 4,202,236 | 5/1980 | Wilcox et al. | 84/1.03 |
| 4,297,934 | 11/1981 | Imamura et al. | 84/1.03 |
| 4,327,622 | 5/1982 | Aoki | 84/1.03 |
| 4,344,345 | 8/1982 | Sano | 84/1.03 |
| 4,357,853 | 11/1982 | Rösler et al. | 84/1.01 |

*Primary Examiner*—Forester W. Isen

*Attorney, Agent, or Firm*—Toren, McGeady and Stanger

[57] ABSTRACT

A musical instrument includes a keyboard having a number of keys which produce input signals corresponding to different musical chord progressions which may be selected by a user. The instrument also includes a synthesizer for producing certain ones of a number of different chords in four voices in response to control signals, and control circuitry including a storage device for storing a number of algorithms which determine the control signals wherein the synthesizer produces the selected musical progression. Each successive chord of the selected progression is computed in accordance with one of the algorithms stored in the storage device.

10 Claims, 11 Drawing Figures

HARMONY MACHINE

BACKGROUND OF THE INVENTION

1. Field of the Invention

The present invention relates generally to electronic musical instruments, and particularly to an instrument which allows a user to compose and simultaneously play a musical piece in a number of voices which are continuously computed within the instrument, without previously stored music patterns.

2. Description of the Prior Art

Conventional electronic musical instruments or synthesizers operate only to provide particular notes or chords which are keyed into the instrument by the user. Accordingly, these instruments require circuitry to store the various notes and chords which the user may select while playing the instrument.

For example, Hall et al., U.S. Pat. No. 4,248,118, issued Feb. 3, 1981, relates to an electronic musical instrument for deriving the harmony desired by the user from his or her manipulation of a standard keyboard. The Hall et al. instrument includes processing means for correlating a number of playing key pattern representations with each chord type desired to be recognized, and a considerable amount of memory is required to carry out such processing.

It will be appreciated that the electronic musical instruments of the prior art operate to produce notes and chords in a direct correspondence with the key or keys actuated by the user on a conventional type of keyboard. Further, the music so produced usually is only in a single voice. Therefore, the prior electronic musical instruments simply do not allow the user to compose and play simultaneously a musical piece in more than one voice.

SUMMARY OF THE INVENTION

An object of the present invention is to provide an electronic musical instrument capable of producing a musical piece in one or more voices, without the need for permanent storage of certain notes or chords.

It is another object of the present invention to provide an electronic musical instrument which, in response to actuation of a single key on a keyboard, will produce a progression of chords, in one or more voices, wherein the correctness of each successive chord is assured by an algorithm which is programmed into the instrument.

It is yet another object of the present invention to provide a musical instrument which, while producing a progression of chords in response to actuation of a single key by the user, can shift to a different progression of musically correct chords, in one or more voices, in response to actuation by the user of different keys on the keyboard.

In accordance with the present invention, a musical instrument includes keyboard means including a number of separately actuable keys for providing input signals corresponding to different musical progressions which may be selected by the user, and synthesizer means for producing certain ones of a number of different chords in response to control signals. Control means coupled between the keyboard means and the synthesizer means operates to compute the control signals and provide them to the synthesizer means. The control means includes means for storing a number of algorithms for determining the control signals, so that the synthesizer means produces the selected musical progression. Each successive chord of the musical progression is computed in accordance with one of the stored algorithms.

For a better understanding of the present invention, reference is made to the following description and accompanying drawing, while the scope of the present invention will be pointed out in the appended claims.

DETAILED DESCRIPTION OF THE INVENTION

Figure 1:
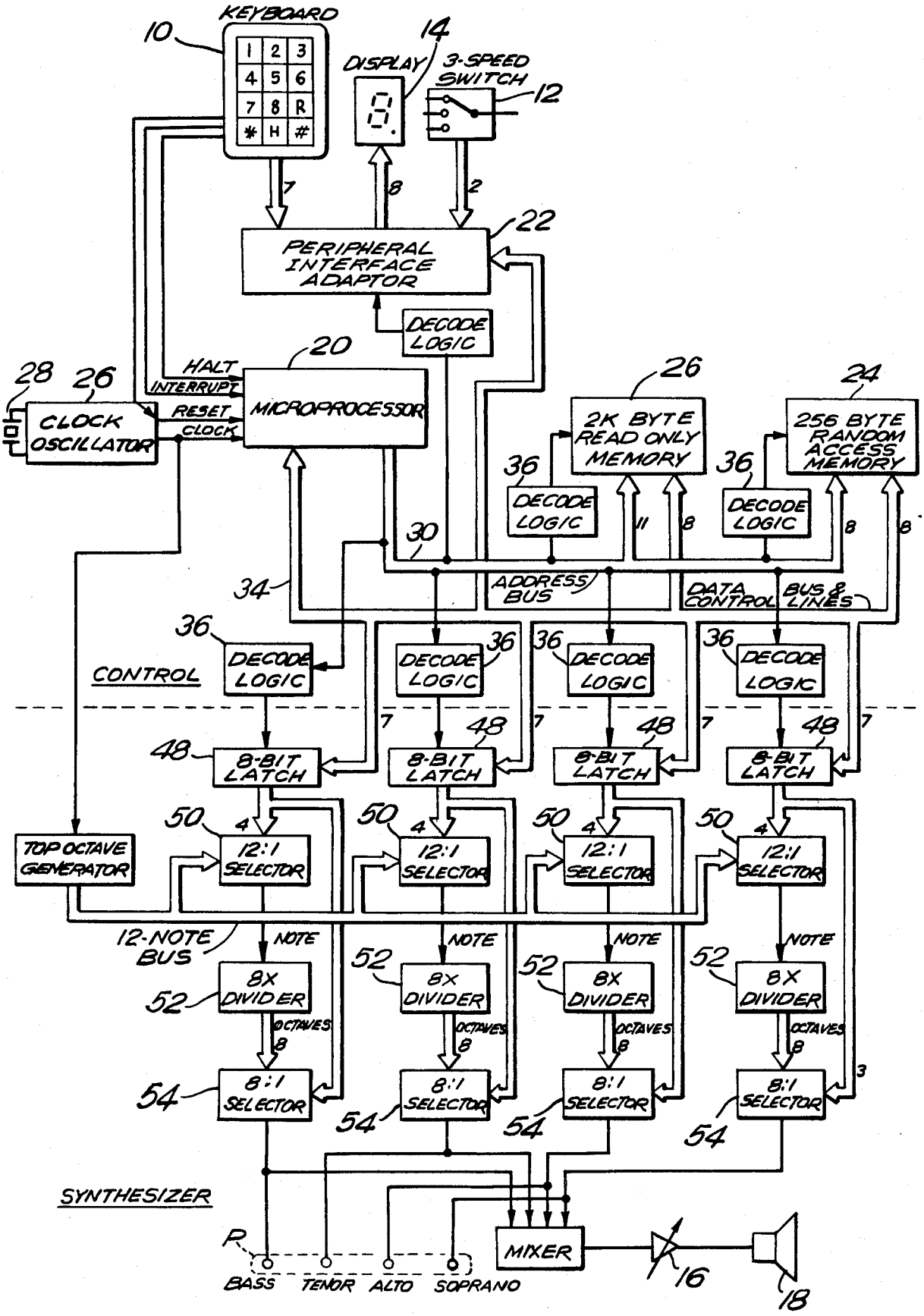
FIG. 1 is a logical block diagram of a musical instrument according to the present invention.

FIG. 1 is a logical block diagram of an electronic musical instrument according to the present invention. Basically, the musical instrument includes a control portion, represented in the upper half of FIG. 1, and a synthesizer portion which is represented in the lower half of the figure.

The control portion operates to recognize input signals which are created when a user depresses one of a number of character keys on a keyboard 10, and when a 3-position speed or tempo selector switch 12 is set to a desired one of three musical speeds. Both the keyboard 10 and switch 12 may be arranged on a panel (not shown), together with a 7-segment light emitting diode (LED) display 14, the latter indicating the current beat of the music relative to a starting beat as music is produced by the instrument. A slide potentiometer for controlling the volume of an amplifier 16 in the synthesizer portion of the instrument also may be included on the instrument panel, together with a grille behind which is supported a loudspeaker 18.

Figure 2A:
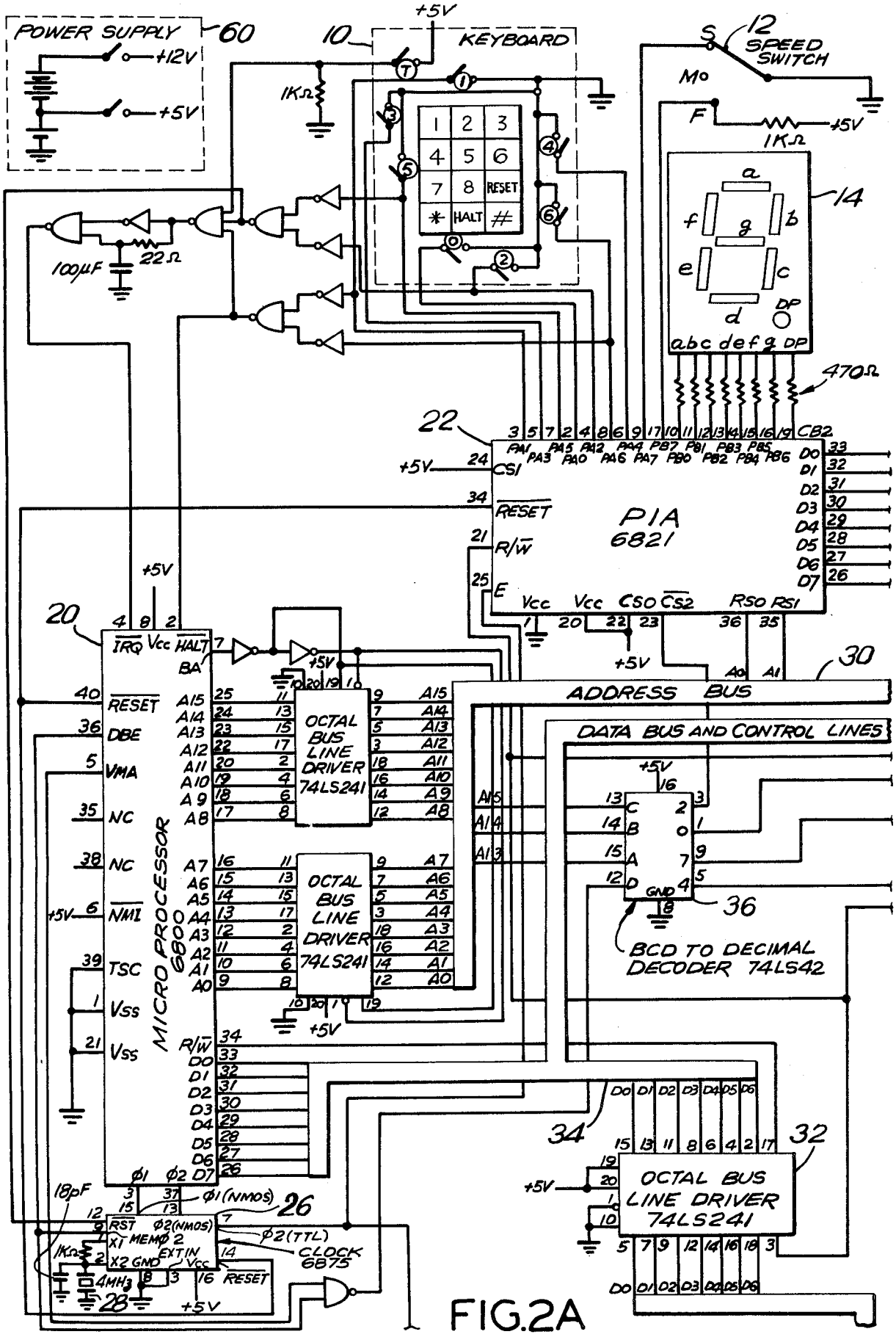
FIGS. 2A–2D show a schematic diagram of the musical instrument of the present invention, wherein FIGS. 2A & 2B correspond to a control portion, and FIGS. 2C & 2D correspond to a synthesizer portion.
Figure 2B:
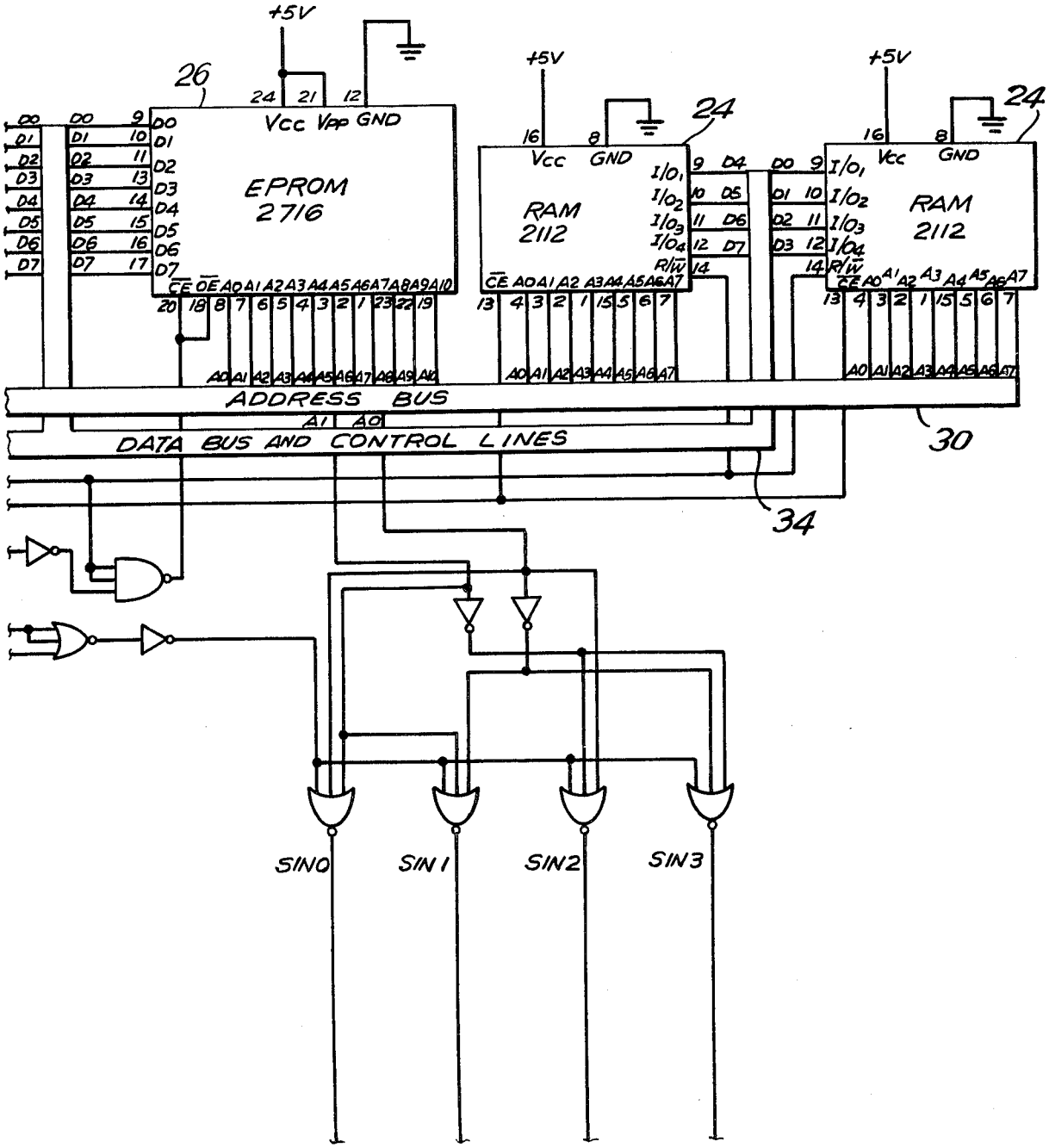

The control portion of the present instrument, which is disclosed in greater detail in FIGS. 2A and 2B, can be built around an 8-bit microprocessor 20 such as, e.g., device type MC 6800 manufactured by Motorola, in Austin, Tex. Other devices also may be used such as types 8080, Z 80, or 6502, provided that the peripheral hardware and operating software are designed accordingly. In the illustrated embodiment, a peripheral interface adapter 22 (PIA), device type 6821 also manufactured by Motorola, is employed to enable the microprocessor 20 to accept input from the keyboard 10 and the 3-position speed selector switch 12, and to provide an output to the LED display 14. The keyboard 10 in the present embodiment has 12 keys, 10 of which are used for selecting different corresponding musical progressions, and to provide an interrupt to the microprocessor 20. The two remaining keys of the keyboard 10 are used for entering reset and halt instructions to the microprocessor 20.

A 256-byte random access memory 24 such as, e.g., a pair of device types 2112, is used as a scratch pad for the computation of musical notes, for storage of previously produced chords, as well as for storing other data needed by algorithms contained in the software, and a stack pointer.

The instrument software is programmed into a 2K-byte read only memory 26 such as, for example, an EPROM (device type 2716). Provision may be made to connect an external ROM or RAM through a plug (not shown) selected by a switch on the instrument board, for program development.

A clock oscillator 26 such as, e.g., device type 6875 by Motorola, provides clock pulses to the microprocessor 20, the pulses being derived from a 4 MHz crystal 28. A pair of octal bus line drivers (type 74LS241) are provided between the address ports of the microprocessor 20 and an address bus 30 of the control portion of the instrument, as shown in FIG. 2A. The same or an equivalent type octal bus line driver 32 also is provided between a data bus 34 in the control portion of the instrument, and logic circuitry in the synthesizer portion, as shown in FIGS. 2A, 2C and 2D.

Decoding logic between the address bus 30 in the control portion, the random access memory 24 and read only memory 26 of the control portion, and logic circuitry in the synthesizer portion, is provided by a BCD to decimal decoder 36, e.g., device type 74LS42, together with appropriate AND/OR/NOT logic, as shown in FIGS. 2A and 2B. Of course, the decoding logic could be implemented in numerous different ways. For example, the BCD to decimal decoder 36 could be replaced entirely by appropriate AND/OR/NOT logic.

The circuitry of the synthesizer portion of the present musical instrument is discussed in greater detail below.

Figure 2C:
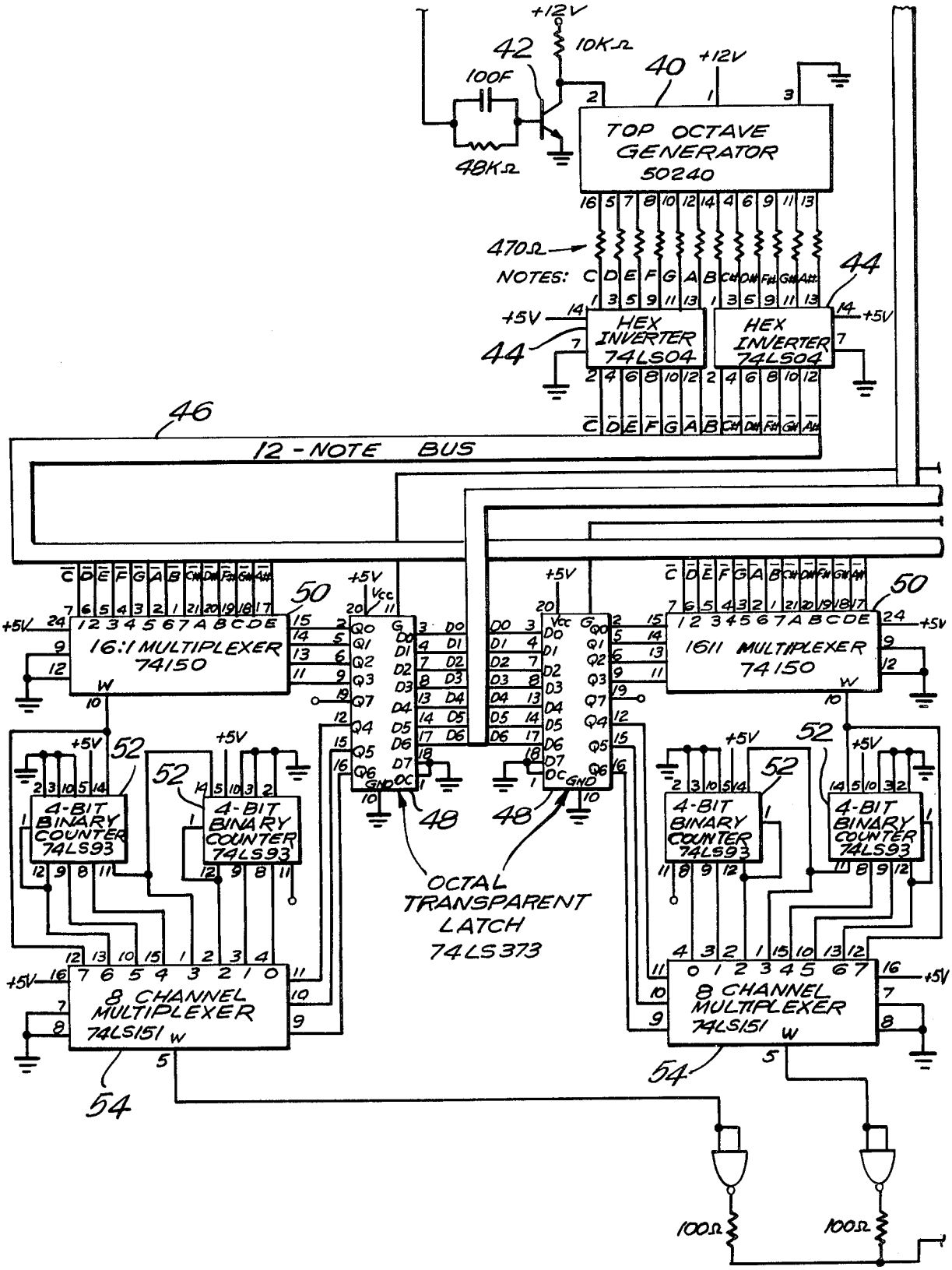
Figure 2D:
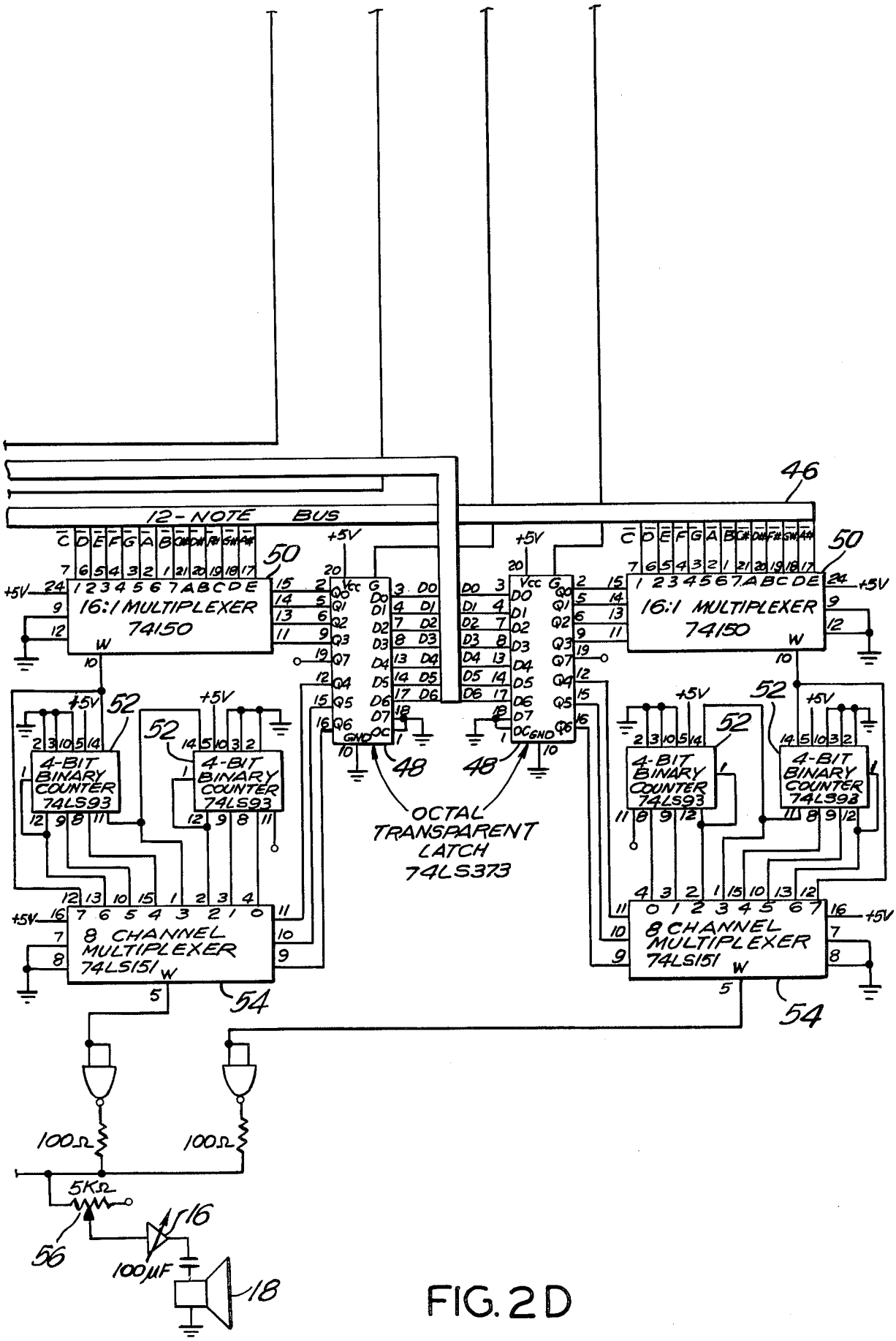

A top octave generator such as, e.g., device type 50240 manufactured by Mostek in Carrollton, Tex., is driven by the clock oscillator 26 associated with the microprocessor 20 through a transistor (e.g., type 2N2222), as shown in FIGS. 2A and 2C. The top octave generator 40 generates the 12 notes of the temperate system in the highest octave. The 12-note outputs of the top octave generator 40 are buffered through a pair of hex inverters 44 (e.g., device types 74LS04) and form a 12-note bus 46 in the synthesizer portion of the instrument.

A set of four octal transparent latches 48 (e.g., device types 74LS373) operate to latch data provided from the data bus 34 by the octal bus line driver 32 in the control portion of the instrument and, in turn, control corresponding selectors 50 comprising a set of four 16:1 multiplexers (e.g., device types 74150) each arranged to select one of the 12 notes produced by the top octave generator 40 according to the lower four bits stored in the corresponding latch 48. Each of the four selectors or multiplexers 50 thus operates to choose one out of the 12 notes for each of four voices of harmony which the present musical instrument is capable of producing.

The frequency of the note selected for each voice by each of the four selectors 50, is then divided by two, eight times by a pair of 4-bit binary counters (e.g., device types 74LS93), thus providing the note in eight octaves. The particular octave to be provided by each voice is determined by a corresponding 8:1 selector 54 comprising an 8-channel multiplexer, e.g., device type 74LS151. Each of the four selectors 54 is controlled by the upper three bits on the data bus which are stored in each of the four latches 48. In this way, one among 96 possible notes ($8\times12$) can be uniquely selected by the microprocessor 20. The four voices can be individually extracted through an external plug P (FIG. 1). In the synthesizer portion of the instrument, the voice outputs from the four selectors 54 are mixed, fed to the buffer/amplifier 16 having a volume control 56, and finally to the loudspeaker 18.

Power for the entire circuitry of the present musical instrument is supplied by batteries 60 (FIG. 2A) which provide suitable output voltages. The instrument can have a built-in battery charger (not shown) and, by way of a suitable plug (not shown), the instrument can be powered by an external power supply.

Some of the distinctive features of the present musical instrument, and specific examples of its operation, will now be described.

The present instrument allows a user to compose and simultaneously play a piece of music in four voices. As in other musical instruments, the user controls the music by pressing keys, through which he or she selects musical "ideas", while the machine electronically combines notes and plays them. The present instrument, however, exhibits some degree of intelligence in that it combines certain controlling software which embodies some knowledge of the rules of music composition, with hardware which produces the sound.

Another distinguishing feature of the present musical instrument is that it operates and produces harmony in four voices. Most, if not all, musical instruments on the market deal with only one voice. Obviously, four harmonically related voices are much more pleasing to the ear than one, especially if the single voice is electronically operated. The somewhat unpleasant response of the ear to such artificial sounds thus is compensated in the present musical instrument by providing the more pleasing sound of four harmonically well related notes, at one time.

The unavailability of electronic musical instruments operating in four voices simultaneously may have been, prior to the present invention, attributable to the fact that such a relatively large degree of power and freedom of musical composition are generally unmanageable by the average user. It is difficult enough to deal with one voice, and nearly impossible to manage four voices at once in real time. The present musical instrument, however, overcomes this difficulty by the use of certain controlling software which is outlined basically in FIGS. 3–8, and discussed in detail later below.

Although the user is in full control of a musical piece with the present instrument, as is in the case in the prior electronic musical instruments, the present instrument automatically solves all problems of assembling and concatenating four voices according to good musical procedures.

Furthermore, the present instrument takes over when the user does not operate it properly, so that the instrument can be played with no previous musical background whatsoever, although greater skill can be developed in playing it, as in the case of conventional instruments. The present musical instrument therefore solves automatically the details of handling four voices. Within the framework of the computer discipline called "artificial intelligence", the present instrument thus has a musical style of its very own.

When the user is ready to operate the instrument, the power supply 60 (FIG. 2A) is switched to power up the instrument circuitry, and the user then selects the speed or tempo with the speed selector switch 12. The "reset" key on the keyboard 10 is then depressed, and the instrument acknowledges by displaying a dot on the LED display 14.

The user must then press key 1, 2 or 3 to select one of three possible musical positions of the first chord to be produced. Next, the display then prompts for a desired progression by displaying a letter "P". The user can now select among 10 musical progressions by pressing one out of 10 possible keys, and music in four-voice harmony is produced by the instrument right away. Each progression is a kind of cyclical, well defined musical contour in four voices. However, chords do not repeat, though they show a strong affinity with one another after a determined number of beats, depending on the particular progression selected.

No musical notes are stored in the present instrument. The rules of musical shape which govern the notes and chords produced within the instrument are embodied in the form of algorithms programmed into the read only memory 26 in the control portion of the instrument. Accordingly, the notes of each chord are computed at every beat. A progression can start with any note, depending of course on the previous chord, as good musical voice leading dictates.

After the music produced by the instrument has begun, the user can at any time press a key on the keyboard 10 to change to another musical progression. The instrument acknowledges by prompting a dot on the LED display 14. However, the newly selected progression may not begin right away. The instrument may continue with the old progression for one or two beats in order to select the most pleasing instant, from a musical viewpoint, to effect the transition period. The transition is indicated by vanishing of the dot on the LED display 14, at which moment the new progression begins from the chord where the previously selected progression left off. While playing, music is produced by the present instrument in a range encompassing eight octaves.

The instrument contains, in the control software, a provision allowing it to take over and override user commands when these lead to obvious musical mistakes. Also, should the user not press any key for 16 beats, the machine "presses" a key at random corresponding to either one of two key-changing sequences or to a final cadence progression. Further, should the pitch of the four voices get too high, the instrument starts a progression to reverse the voice flow toward lower pitches. It behaves analogously when the music gets too low in pitch. The user can automatically override this feature by re-pressing progression keys, should he nevertheless desire to explore the very high or very low register.

To terminate the piece, the user selects the final cadence progression, after which the instrument automatically resets for a new piece. At any time during the play, the 7-segment LED display 14 indicates, by counting forward from one to zero, the current beat number. This may be used as a reference for writing a score for the instrument. A user therefore may write, for example, that key 4 should be pressed at beat 8, then key 9 at the reappearance of beat 3, and so on. Due to the fact that the music lives in real time, it is no disadvantage in having to read one digit only, since at any moment the one digit completely identifies the particular beat.

A special key labeled "H" for halt, allows the user at any time to stop on a particular chord, in order to hear fully and explore the four voices. Through repeated actuation of this key, the user thus could "single step" through each progression, to hear each chord at leisure and possibly in order to study the inner logic of each progression. Signals representing each individual voice may be accessed by the user through a plug, and each signal could be connected to a separate amplifier, e.g., for quadraphonic effect or to control the individual level of each voice; to a mixer; or to a recording device. Through the same plug, the user also can connect an external power supply to operate the machine over long periods of time, or to charge the batteries for field operation.

The user thus has at his or her disposal a complete instrument to generate pieces in four-part harmony, like chorales. He can select among 10 progressions, including modulating sequences through which he can lead the music to any key of the temperate system, and a final cadence to properly terminate the piece.

Each of the 10 progressions will now be explained in detail.

It is first noted that each progression is not a fixed pattern of notes of chords. Rather, it is merely an idea, or a rule, or a musical sequence of a definite and easily identifiable flavor. The actual notes of the chords, and sometimes the chords themselves, will actually be different between one selection of a progression at one moment, and another selection of the same progression at another moment. This must be the case in order to ensure the correctness of the harmonic flow and of the leading of the voices.

For convenience, the 10 available progressions will be divided in four groups, namely, 2-chord patterns, scales, modulating sequences, and final cadence. For all progressions, except the modulating sequences, the music remains in the same key.

In the 2-chord group are the progressions Nos. 1, 2, 3, 4 and 5. As the same suggests, they handle cyclical recurrence of 2-chord patterns, as follows:

In progression 1, the bass jumps through a circle of fifth in the same key, i.e., it jumps up a fourth and down a fifth;

In progression 2, the bass jumps up a fourth and down a third;

In progression 3, the bass jumps down a third and up a second;

In progression 4, the bass is tied within the measure and ascends one step after the bar; and In progression 5, the bass is tied across the bar and descends one step on the second beat.

It should be noted that progressions 1, 3 and 5 cause the music to go downward in pitch, while progressions 2 and 4 let the music ascend to higher registers.

The scales group includes the 7-chord patterns and, as the name implies, are harmonized major scales, as follows:

In progression 6, the bass ascends stepwise; and

In progression 7, the bass descends stepwise.

Because of their periodicity, these two progressions do not cause an overall ascent or descent of the music.

In the modulating sequences group (FIG. 5), are two non-cyclical 2-chord patterns:

Progression 9 causes a change of key toward a key with one sharp more than the preceding key, e.g., from D to A, or from E♭ to B♭; and Progression 10 causes a change of key toward a key with one flat more than the preceding key, e.g., from F to B♭, or from B to E.

In both cases, the sequence consists of a $V_4^6$ chord in the new key so that no new sharps or flats are yet introduced, followed by a $V_7$ chord to trigger the modulation.

Upon completion of a modulating sequence, the instrument resumes by playing a progression the user may have selected during the modulating process or, failing that, randomly selects one progression among progressions 1–7. From then on, the music is played in the new key. Continuous selection of one of these modulating sequences would let the instrument explore all keys of the temperate system. Also, through alternate selection of the above modulating sequences, the user can cause a transition to the next key and back to the original one. The fact that it is possible to effect a change involving no more than one sharp or flat at a time is no restriction, but is rather in agreement with rules of basic tonal classical harmony.

The final cadence (FIG. 6) is a non-cyclical 5-chord sequence to bring the music to its final rest. Unlike any of the above progressions, it does not allow selection of a following progression. The chord sequence is $IV_6$, (or $IV_5^6$, depending on the context), $V_4^6$, $V_7$ with suspension, $V_7$ resolved, and $I_3^5$ for three beats. The voices are computed in such a way that the last chord always ends with the octave in the upper voice.

All the above progressions embody some basic rules of tonal classical harmony. However, such "rules", unlike in scientific disciplines, are not deterministic equations, but rather prescriptions about what not to do, and empiric guide lines such as the "rules" for good writing. Therefore, a distinguishing feature of the present instrument is that it embodies algorithms within its control hardware which cause the synthesizing portion of the machine to generate musical pieces in four-part harmony wherein the harmony is automatically "fixed up" for the user's benefit. Because of the embodied algorithms, basic errors like parallel octaves, parallel fifths or incorrect jumps do not occur. During voice leading, unless successive chords have at least one note in common, contrary motion predominates except when the cyclical effect of the progression is maintained.

As explained above, the user selects the initial position of the starting chord, i.e., whether he wants the octave, the third or the fifth in the top voice. The first chord is always on the tonic of the key of C, though it may be harmonized differently depending on the progression chosen. The upper three parts are in close position and the distance between bass and tenor does not exceed one octave during the play (some progressions check this and correct errors). Also, as explained above, the pitch of the music is gradually corrected if it gets too high or too low, by automatic selection of a progression which can overcome this occurrence.

The smoothness of the transition of one chord to another, as well as from one progression to the next, is ensured by computation of the notes of the next chord from the previous one, and sometimes from the one preceding the last. The same applies to the bass. For example, if a progression is expected to end with the bass on some degree, a transition to an ascending scale would cause the new progression to start on that degree, and not from the starting first degree.

The harmonic rhythm automatically is taken into account by the design of the progressions. Also, as previously explained, the user is not allowed to freely jump into a progression at will—he may indeed select a new progression at any time he chooses, but the instrument, upon acknowledging the command, reserves itself the right to postpone execution of the selection until the proper moment has arrived. This ensures good voice leading and harmonic rhythm.

The control software embodied in the read only memory 26, for executing each of the 10 progressions, will now be explained further with reference to FIGS. 3–8.

Figure 3:
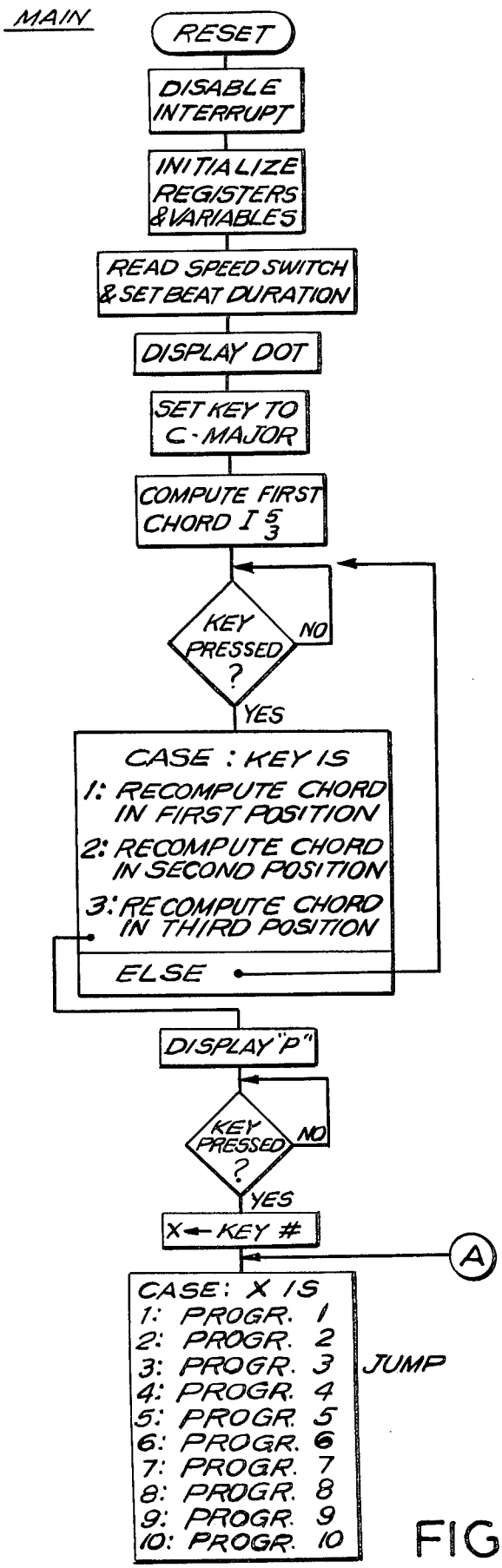
FIG. 3 is a flow chart illustrating a MAIN routine carried out by the control portion of the present musical instrument.

FIG. 3 represents a MAIN routine in which the RESET step corresponds to actuation by the user of the RESET key on the keyboard 10, wherein an input pulse is applied to the clock oscillator 26 (device 6875 in FIG. 2A) and to the microprocessor 20. The RESET step in FIG. 3 also corresponds to termination of the cadence progression of FIG. 6, in which case no input pulses are supplied through the keyboard 10.

The step labeled READ SPEED SWITCH & SET BEAT DURATION corresponds to loading of input information or bits into the PIA 22 (device 6821 in FIG. 2A), the PIA being physically connected to the speed selector switch 12 through the device terminals PA7 & PB7.

The DISPLAY DOT step in the MAIN subroutine corresponds to storing of the pattern displaying a dot to a special output pin CB2 of the PIA 22.

The step labeled KEY PRESSED? implies reading, or loading, the input pattern of port A of the PIA 22 (terminals PA0–PA6 of the 6821 device shown in FIG. 2A). This step represents the software recognition of which key of the keyboard 10 has been pressed by the user.

The remaining labeled steps in the MAIN routine are self-explanatory and within the capability of a skilled programmer to implement, given the logic circuitry of FIGS. 2A–2D.

Figure 4:
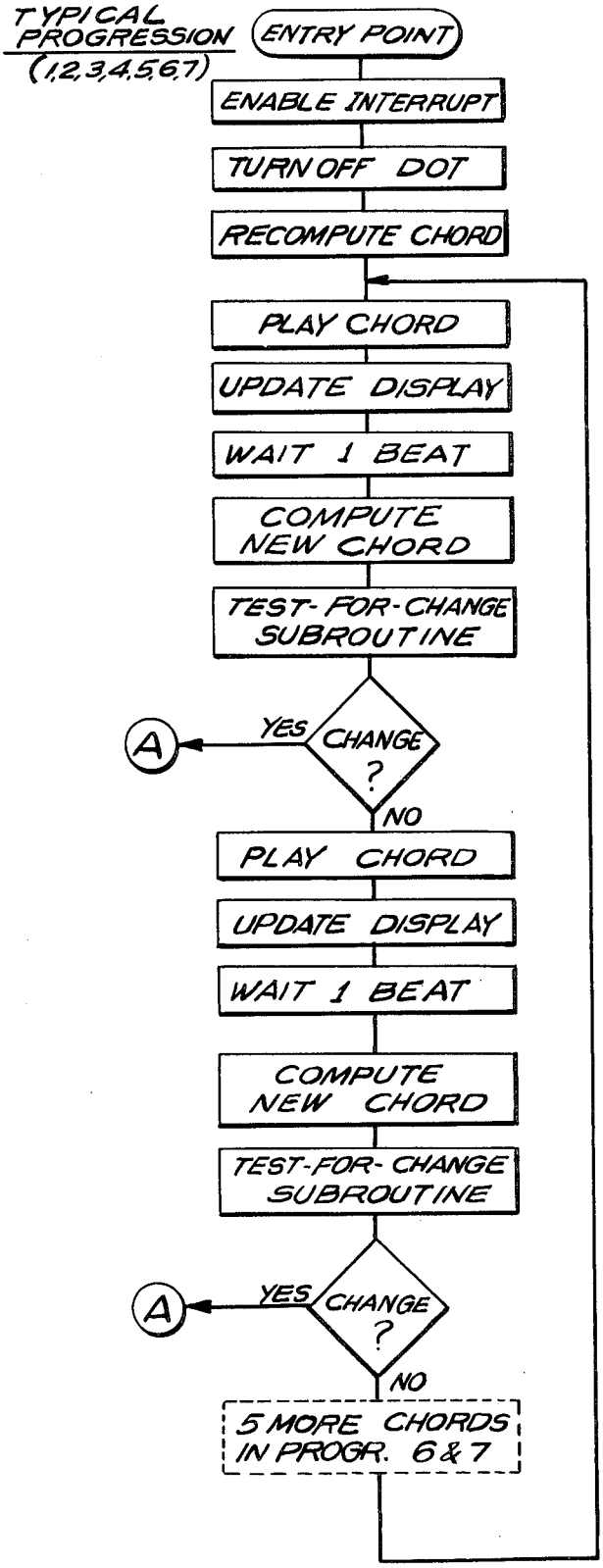
FIGS. 4–6 are flow charts illustrating the operations of the control portion and synthesizer portion of the present musical instrument when certain progressions are selected by the user.

The routine of FIG. 4, headed TYPICAL PROGRESSION, represents the data flow and computations within the logic circuitry of the instrument when any one of progressions 1–7 is selected by the user on the keyboard 10.

The step TURN OFF DOT is similar to the step DISPLAY DOT in the MAIN routine of FIG. 3, but with the opposite effect.

During the PLAY CHORD step, each of four bytes representing a note in one of the four voices produced by the instrument, is entered and stored in the corresponding 8-bit latch 48 in FIGS. 2C and 2D. The four latches 48 are at four distinct and contiguous addresses, so that in the PLAY CHORD step, each note-byte is delivered sequentially to a corresponding latch 48. As explained above, the lower four bits select a note among 12 from the corresponding multiplexer or selector 50, and the upper three bits select a corresponding octave from the associated 8-channel multiplexer or selector 54, as indicated in FIGS. 2C and 2D. The result of the PLAY CHORD step thus is an activation of the complete circuit for the flow of music to the loudspeaker 18.

The UPDATE DISPLAY step of the TYPICAL PROGRESSION routine includes incrementing, by one, a memory address representing the beat counter, and thereafter entering the pattern corresponding to this digit to port B of the PIA 22 (terminals PB0–PB6 of device 6821 shown in FIG. 2A). Accordingly, the actual digit representing the beat number appears on the LED display 14.

Figure 5:
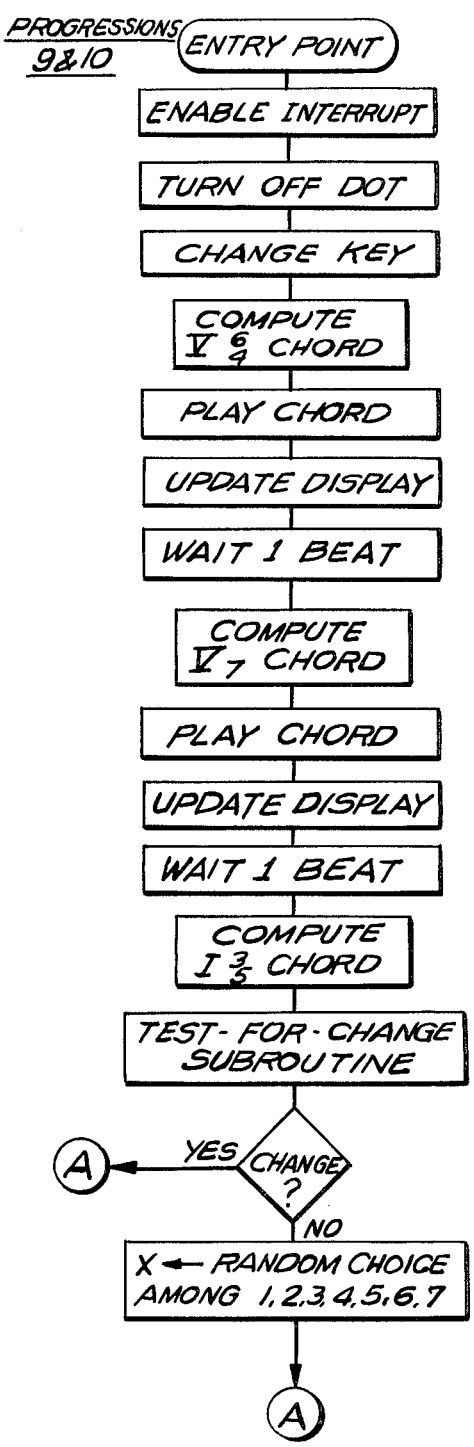
Figure 6:
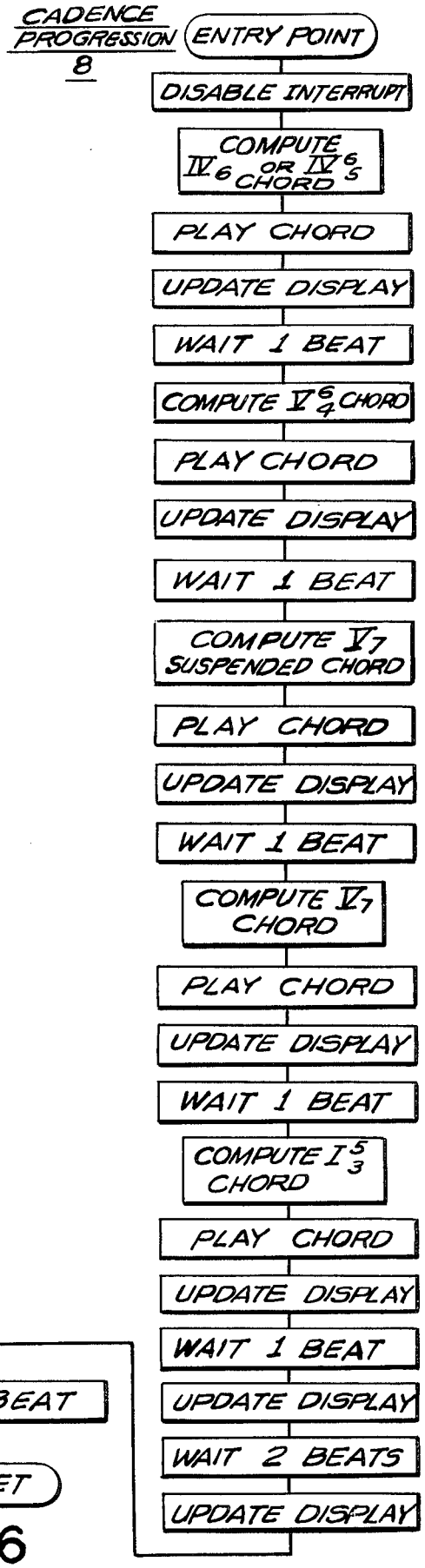
Figure 6:
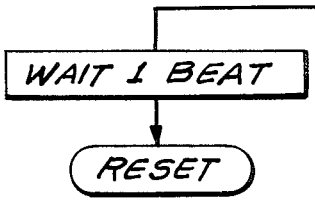

The routine of FIG. 5, headed PROGRESSIONS 9 & 10, and the routine of FIG. 6, headed CADENCE, PROGRESSION 8, include steps some of which have been discussed above in connection with the routines of FIGS. 3 and 4, and call for additional operations, the implementation of which would be self-evident to a skilled programmer working with the logic circuitry of FIGS. 2A–2D.

Figure 7:
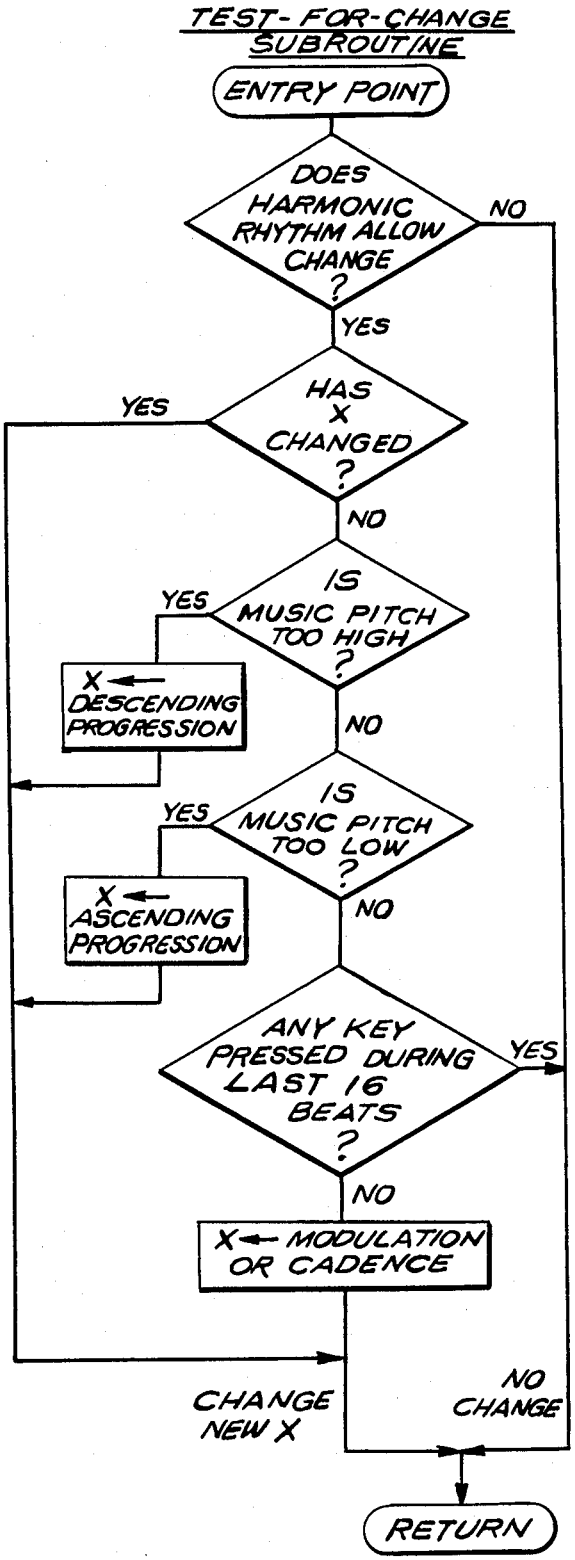
FIG. 7 is a flow chart representing a subroutine in the control portion.

The TEST-FOR-CHANGE subroutine shown in FIG. 7 indicates whether: a key has been pressed recently, the music pitch is too high or too low, in which case the progression changes (new X); or whether there is no change.

Figure 8:
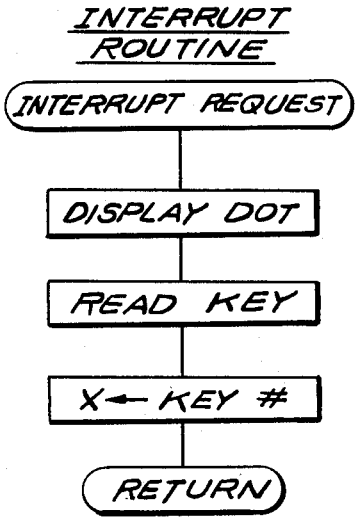
FIG. 8 is a flow chart corresponding to an INTERRUPT routine in the control portion.

Finally, the steps of the INTERRUPT routine of FIG. 8 include DISPLAY DOT which is implemented similarly to the same named step in the MAIN routine of FIG. 3, and a READ KEY step which is carried out in the same manner as the KEY PRESSED step in the MAIN routine.

The harmony musical instrument of the present invention can be viewed as a device for teaching the basics of tonal classical harmony, and, in general, as an example of computer "artificial intelligence" as applied to music theory. It therefore should be of interest to designers of electronic musical instruments on account of its automatic mode of operation in computing four voices. It should also enjoy substantial recognition by manufacturers of computer games and devices for computer-aided instruction for music, and to theorists interested in the application of computer techniques to musicology.

While the foregoing description and drawing represent a preferred embodiment of the present invention, it will be obvious to those skilled in the art that various changes and modifications may be made therein without departing from the true spirit and scope of the present invention.

I claim:

1. A harmony instrument, comprising:

keyboard means including a number of separately actuable keys each key of which generates an input signal which corresponds to a different musical chord progression selected by a user, each progression comprising a plurality of chords;

synthesizer means for producing certain ones of a number of different chords in response to control signals; and control means coupled between said keyboard means and said synthesizer means for computing said control signals and providing said control signals to said synthesizer means in response to said input signals, said control means including means for storing a number of algorithms for determining said control signals so that said synthesizer means produces the chord progression selected by the user, wherein all of the pitches of each successive chord of the progression are computed as a function of the pitches of the previously computed chord in accordance with one of the algorithms in said storing means.

2. A harmony instrument according to claim 1, wherein said synthesizer means includes generator means for producing output signals corresponding to a plurality of different notes forming a top octave, and first selector means coupled to said generator means for selecting among the output signals of said generator means that signal which corresponds to a certain note of said plurality of different notes.

3. A harmony instrument according to claim 2, including divider means coupled to said first selector means for dividing the signal selected by said first selector means to provide output signals corresponding to said certain note in a plurality of octaves.

4. A harmony instrument according to claim 3, including second selector means coupled to said divider means for selecting among the output signals of said divider means that signal corresponding to said certain note in one of said plurality of octaves.

5. A harmony instrument according to claim 1, wherein said control means includes switch means for selecting one of a number of different tempos for the progressions produced by said synthesizer means.

6. A harmony instrument according to claim 1, wherein said control means includes display means for providing indication for promoting user interaction with said instrument for providing indication of internal states of the musical process, and for providing an indication of a current beat number relative to a starting beat of the chords produced by said synthesizer means in order to allow full user control of the instrument.

7. A harmony instrument according to claim 1, wherein said synthesizer means is arranged to produce the progression selected by the user in at least two harmonically-related voices.

8. A harmony instrument according to claim 1, wherein said synthesizer means is arranged to produce the musical progression selected by the user in four harmonically-related voices.

9. A method of producing musical chord progressions in a number of different voices and in harmony with one another, each progression comprising a plurality of chords, comprising the steps of selecting a desired one of a number of separately identifiable progressions by actuating a corresponding single key of a keyboard for each desired progression, each said actuated key producing a corresponding input signal, storing in a memory a number of algorithms each of which corresponds to rules for computing successive chords of a selected progression, computing control signals corresponding to the selected progression in accordance with the corresponding algorithm stored in the memory, and producing successive chords according to the control signals corresponding to the selected progression.

10. The method of claim 9, wherein said producing step includes the steps of generating output signals corresponding to a plurality of different notes forming an octave, selecting among the output signals those signals corresponding to certain ones of said different notes, processing the selected output signals to produce at least some of said notes in different octaves, and combining the selected output signals after said processing step to produce the successive chords in at least two harmonically-related voices.

* * * * *